US009861175B2

(12) United States Patent
Tanaka

(10) Patent No.: US 9,861,175 B2
(45) Date of Patent: Jan. 9, 2018

(54) APPLICATION-BODY-EQUIPPED COSMETIC CONTAINER

(71) Applicant: TOKIWA CORPORATION, Gifu (JP)

(72) Inventor: Masahiro Tanaka, Saitama (JP)

(73) Assignee: TOKIWA CORPORATION, Gifu (JP)

( * ) Notice: Subject to any disclaimer, the term of this patent is extended or adjusted under 35 U.S.C. 154(b) by 0 days.

(21) Appl. No.: 15/026,386

(22) PCT Filed: Jan. 29, 2014

(86) PCT No.: PCT/JP2014/051976
§ 371 (c)(1),
(2) Date: Mar. 31, 2016

(87) PCT Pub. No.: WO2015/052944
PCT Pub. Date: Apr. 16, 2015

(65) Prior Publication Data

US 2016/0213124 A1 Jul. 28, 2016

(30) Foreign Application Priority Data

Oct. 8, 2013 (JP) ..... 2013-210836

(51) Int. Cl.
*A45D 34/04* (2006.01)

(52) U.S. Cl.
CPC ..... *A45D 34/041* (2013.01)

(58) Field of Classification Search
CPC combination set(s) only.
See application file for complete search history.

(56) References Cited

U.S. PATENT DOCUMENTS 637,832 A 11/1899 Rosenberg
3,003,468 A 10/1961 Rosenthal
3,465,673 A * 9/1969 Oppenheim ..... A63H 33/3083 101/328
4,794,857 A * 1/1989 Waters, Sr. ..... B41K 1/22 101/328
5,417,505 A * 5/1995 Voorhees ..... G03G 15/04027 401/208
5,435,245 A * 7/1995 Salisbury ..... B41K 1/38 101/328

(Continued)

FOREIGN PATENT DOCUMENTS

EP 1393649 A1 3/2004
JP 00015882 3/1909

(Continued)

OTHER PUBLICATIONS

International Search Report dated Mar. 18, 2014 for PCT Application No. PCT/JP2014/051976.

(Continued)

*Primary Examiner* — David Walczak
(74) *Attorney, Agent, or Firm* — Moser Taboada

(57) ABSTRACT

A cosmetic container with application body, a liquid cosmetic accommodated in the container being supplied to an application body provided to a tip of the container through an intermediate core, the liquid cosmetic being applied by the application body, in which the application body is disc-shaped, rotatably provided at an outlet of the liquid cosmetic at the tip of the container, and in contact with the intermediate core.

17 Claims, 16 Drawing Sheets

(56) References Cited

U.S. PATENT DOCUMENTS

| | | | | |
|---|---|---|---|---|
| 6,729,788 | B2 * | 5/2004 | Bouveresse | B43K 17/00 401/208 |
| 7,422,389 | B2 * | 9/2008 | Abergel | A45D 34/041 401/208 |
| 2004/0129284 | A1 | 7/2004 | Abergel | |
| 2011/0211902 | A1 | 9/2011 | Le et al. | |

FOREIGN PATENT DOCUMENTS

| | | | |
|---|---|---|---|
| JP | 19910067202 | A | 10/1992 |
| JP | H5035008 | | 5/1993 |
| JP | 4392847 | B2 | 1/2010 |

OTHER PUBLICATIONS

International Preliminary Report on Patentability dated Apr. 12, 2016.

International Preliminary Report on Patentability dated Apr. 12, 2016.for PCT Application No. PCT/JP2014/051976.

Supplementary European Search Report dated Jun. 7, 2017 for Application No. 14852317.8.

* cited by examiner

APPLICATION-BODY-EQUIPPED COSMETIC CONTAINER

TECHNICAL FIELD OF THE INVENTION

An aspect of the present invention relates to a cosmetic container with application body.

BACKGROUND ART

A tool disclosed in Patent Literature 1 below has been known as an applicator for drawing an eyeliner. In the applicator, inner cotton impregnated with eyeliner liquid is accommodated in a container, a rear end portion of a tip of a brush formed by fastening polyester fibers, or the like by urethane resin, or the like is inserted into the inner cotton, and a through-hole is formed along an axial line direction at a center location of the tip of the brush. A threadlike member (application body) formed by binding thread materials including synthetic resin is concentrated inside the through-hole, and a tip of the threadlike member extrudes outward from the container by a predetermined length. In the applicator, the eyeliner liquid impregnated into the inner cotton is delivered to the sharp tip of the threadlike member through the threadlike member, and an eye line corresponding to a thin line can be drawn on an eyelid using the sharp tip.

CITATION LIST

Patent Literature

Patent Literature 1: Japanese Patent No. 4392847

SUMMARY OF INVENTION

Technical Problem

However, when an eye line is drawn using a sharp tip as described above, there are problems in that the tip may be stuck in an eyelid, a skin may be pulled and thus a satisfactory sense of use may not be obtained, and a line becomes discontinuous and thus a clear line may not be drawn.

In this regard, an aspect of the invention provides a cosmetic container with application body capable of improving a sense of use without a skin being pulled, and clearly drawing a line without the line being discontinuous.

Solution to Problem

A cosmetic container with application body according to an aspect of the invention is a cosmetic container with application body, a liquid cosmetic accommodated in the container being supplied to an application body provided to a tip of the container through an intermediate core, the liquid cosmetic being applied by the application body, in which the application body is a disc-shaped, rotatably provided at an outlet of the liquid cosmetic at the tip of the container, and in contact with the intermediate core.

According to the cosmetic container with application body, the application body is in contact with the intermediate core that sends out the liquid cosmetic inside the container, and is disposed in the outlet of the liquid cosmetic at the tip of the container. In addition, the application body has a disc shape and rotates to draw a line at the time of application. In other words, the disc-shaped application body rotates at the time of application, and thus a previously occurring phenomenon in which the tip is stuck is suppressed. As a result, a sense of use can be improved without the skin being pulled, and a clear line can be drawn without the line becoming discontinuous.

Here, the disc-shaped application body may correspond to a shape of a convex lens. In this case, for example, the application body is suitable for an eyeliner, an eyebrow pencil, or the like to draw a thin line.

In addition, the disc-shaped application body may include a groove for liquid accumulation in an annular shape along a circumferential direction on an outer peripheral surface of the application body. In this case, a liquid cosmetic is excellently contained by the groove for liquid accumulation at the time of application. As a result, a clearer line can be drawn.

In addition, the disc-shaped application body may include an annular outer peripheral portion and a space portion on an inner circumference side of the outer peripheral portion. In this case, a liquid cosmetic does not adhere to the space portion on the inner circumference side of the annular outer peripheral portion. Thus, even when the application body sinks into (digs into) a skin at the time of application, only a liquid cosmetic of the annular outer peripheral portion is a liquid cosmetic applied to the skin. Therefore, it is possible to draw a line having a desired constant thickness (constant and thin line) without variation at all times.

In addition, a second intermediate core softer than the intermediate core may be interposed between the application body and the intermediate core. In this case, the second intermediate core is in contact with the application body by an appropriate force at all times, and can reliably transfer the liquid cosmetic to the application body without hindering the application body from rotating.

Advantageous Effect of Invention

As described above, according to an aspect of the invention, it is possible to provide a cosmetic container with application body capable of improving a sense of use without a skin being pulled, and clearly drawing a line without the line being discontinuous.

DESCRIPTION OF EMBODIMENTS

Figure 5:
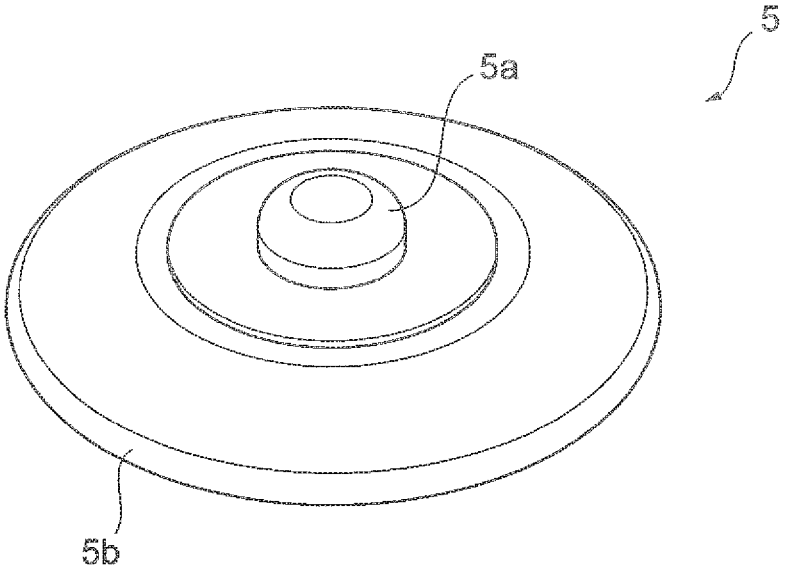
FIG. 5 is a perspective view of an application body of FIG. 4.
Figure 6:
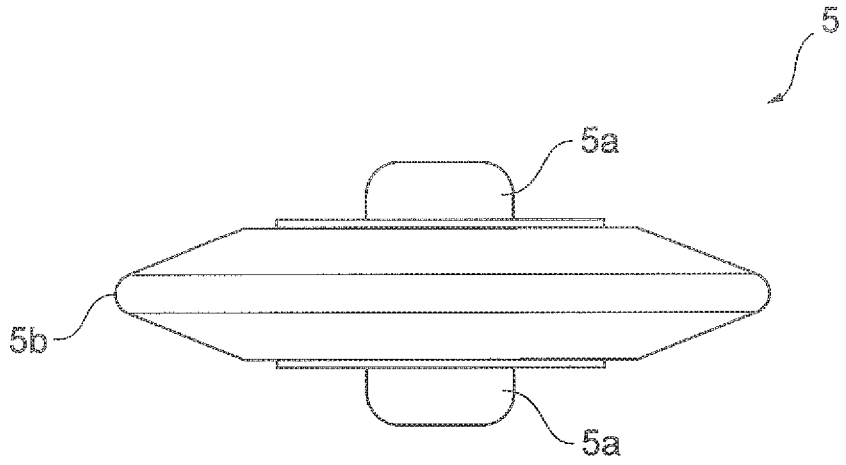
FIG. 6 is a side view of the application body illustrated in FIG. 5.
Figure 7:
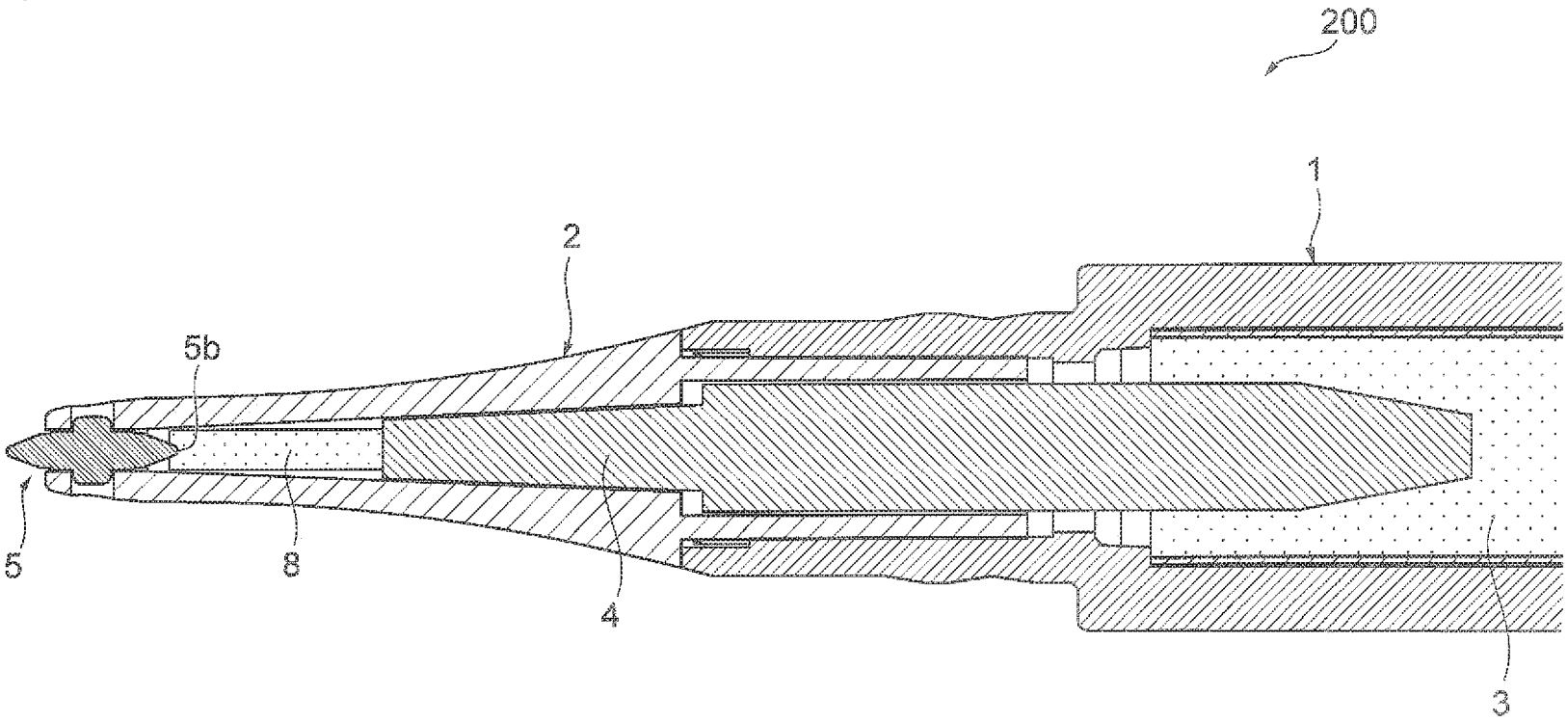
FIG. 7 is a longitudinal sectional view illustrating a main part of a cosmetic container with application body according to a second embodiment.
Figure 8:
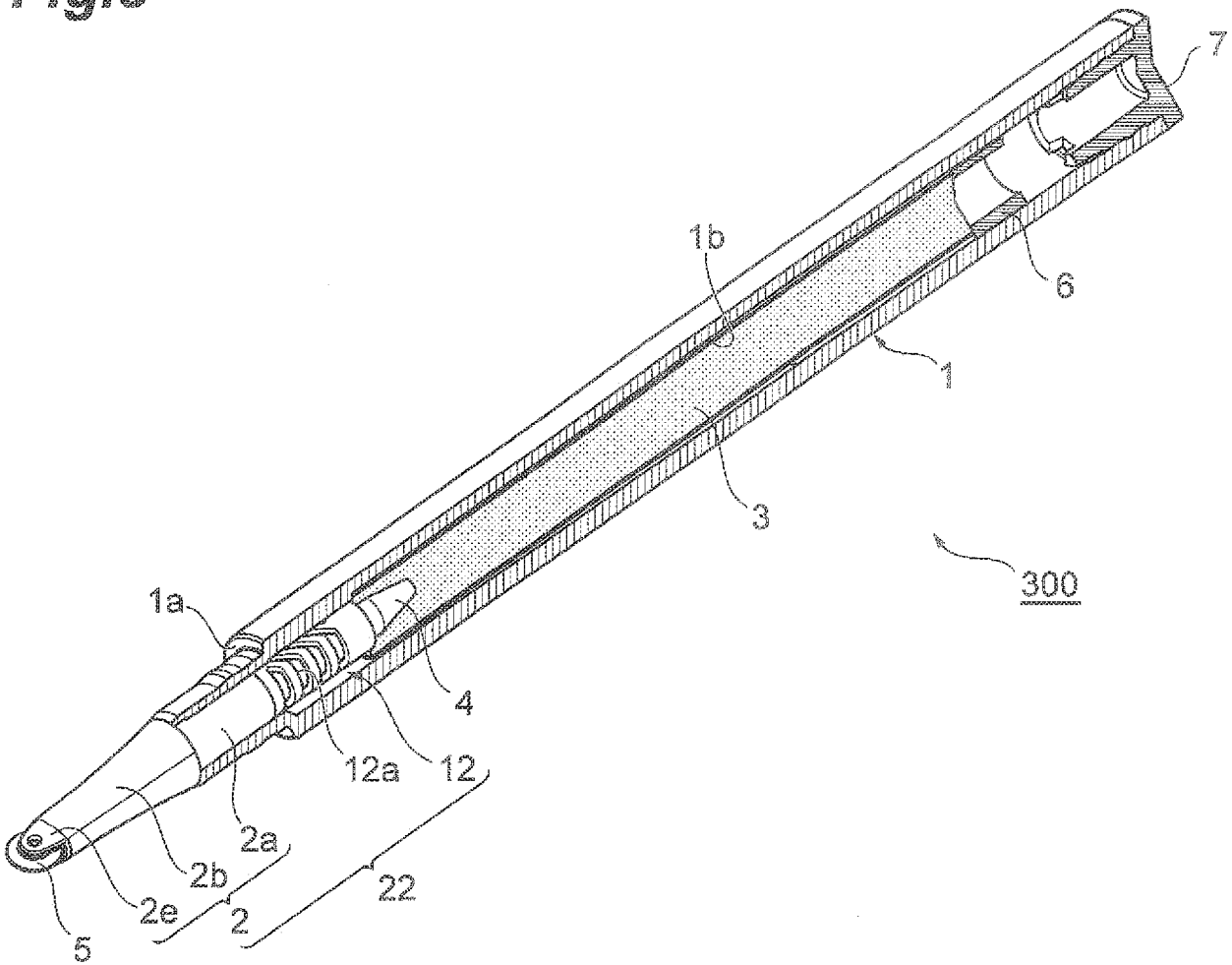
FIG. 8 is a partially broken perspective view illustrating a cosmetic container with application body according to a third embodiment.
Figure 9:
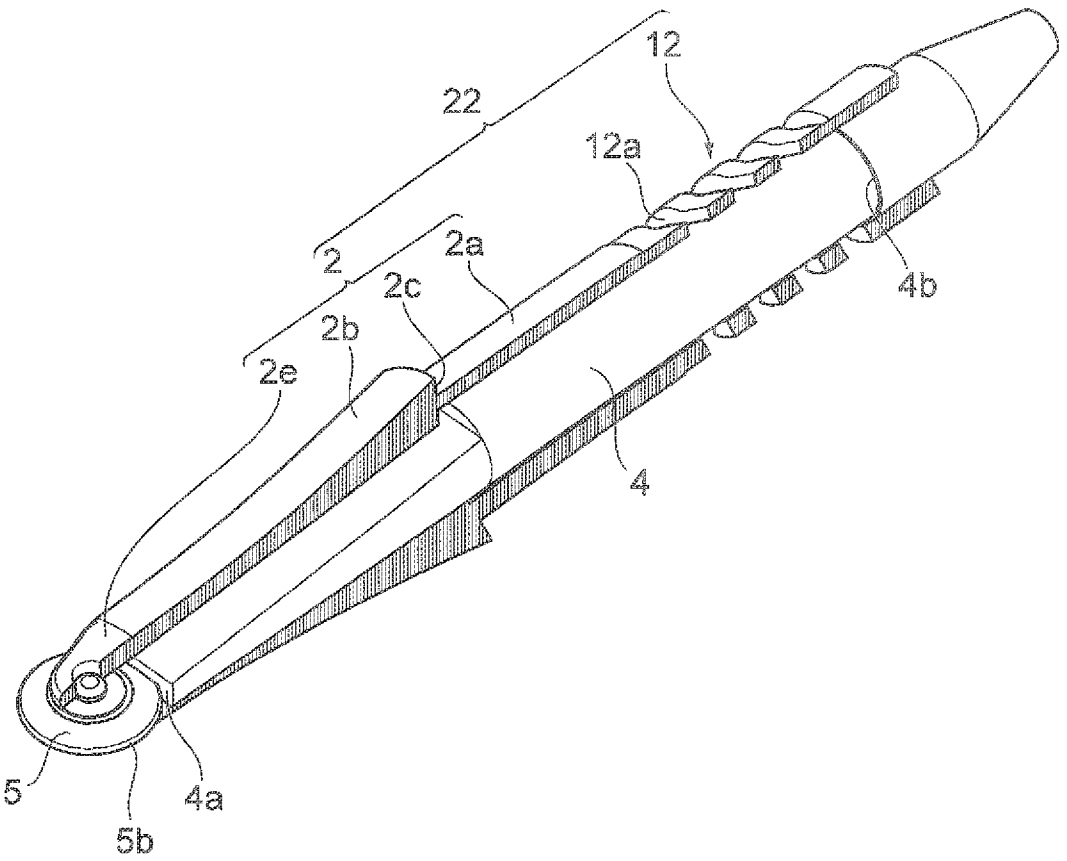
FIG. 9 is a partially broken perspective view illustrating a resin-spring-equipped front tube and an intermediate core of FIG. 8.
Figure 10:
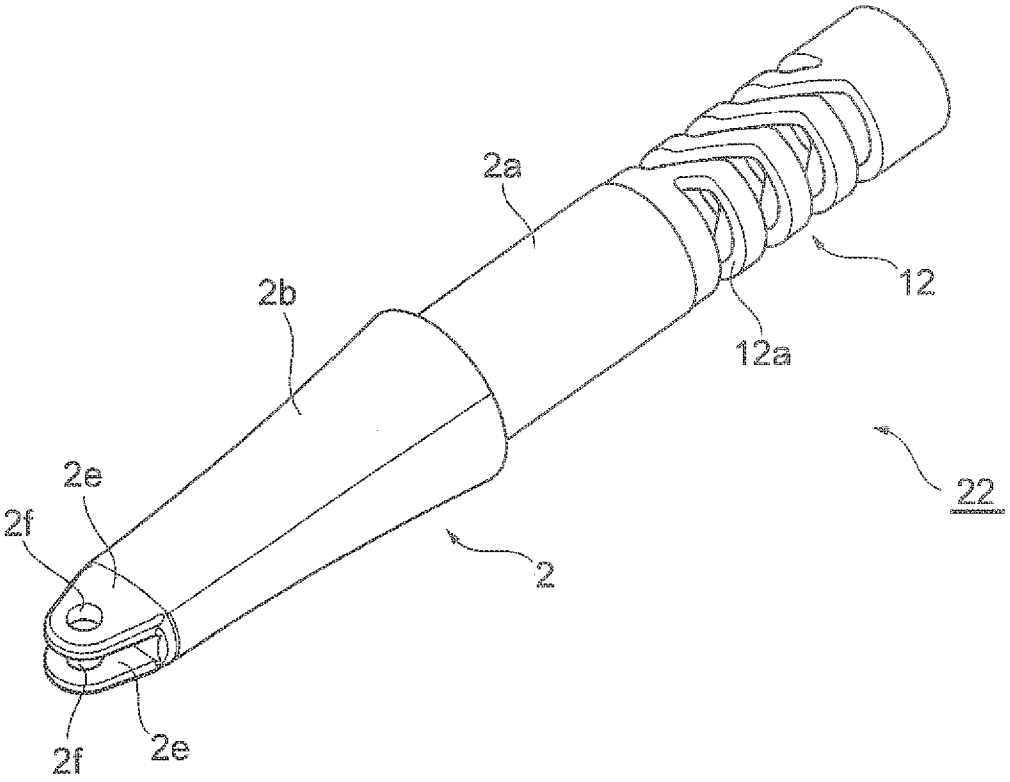
FIG. 10 is a perspective view illustrating the resin-spring-equipped front tube of FIG. 9.
Figure 11:
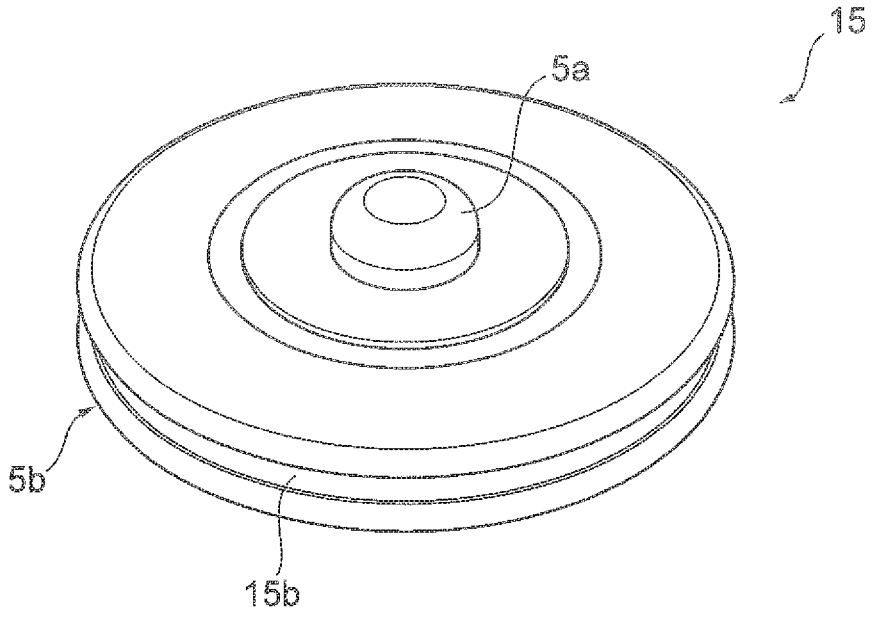
FIG. 11 is a perspective view illustrating an application body of a cosmetic container with application body according to a fourth embodiment.
Figure 12:
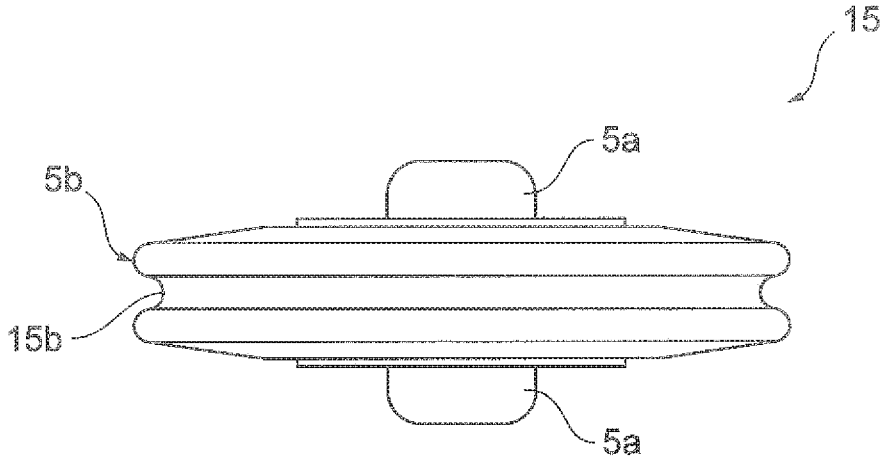
FIG. 12 is a side view of the application body illustrated in FIG. 11.
Figure 13:
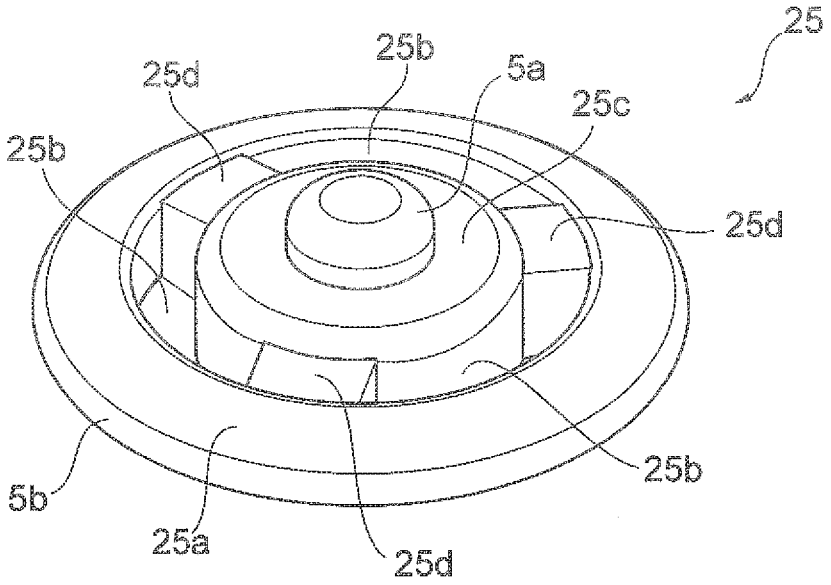
FIG. 13 is a perspective view illustrating an application body of a cosmetic container with application body according to a fifth embodiment.
Figure 14:
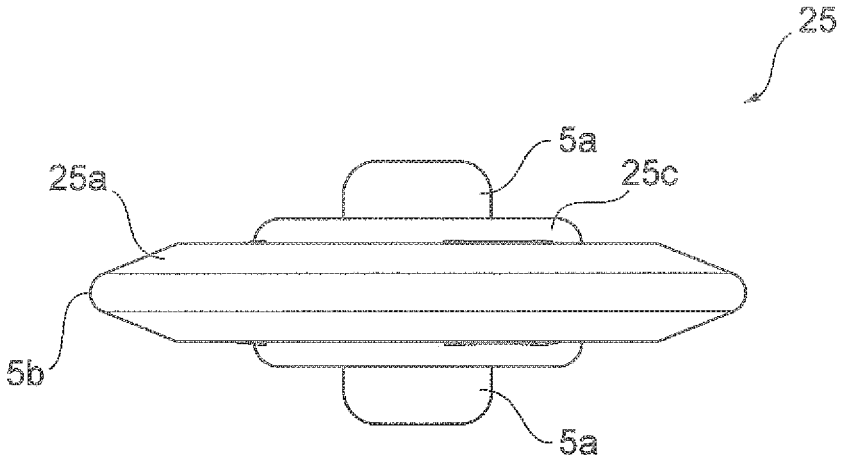
FIG. 14 is a side view of the application body illustrated in FIG. 13.
Figure 15:
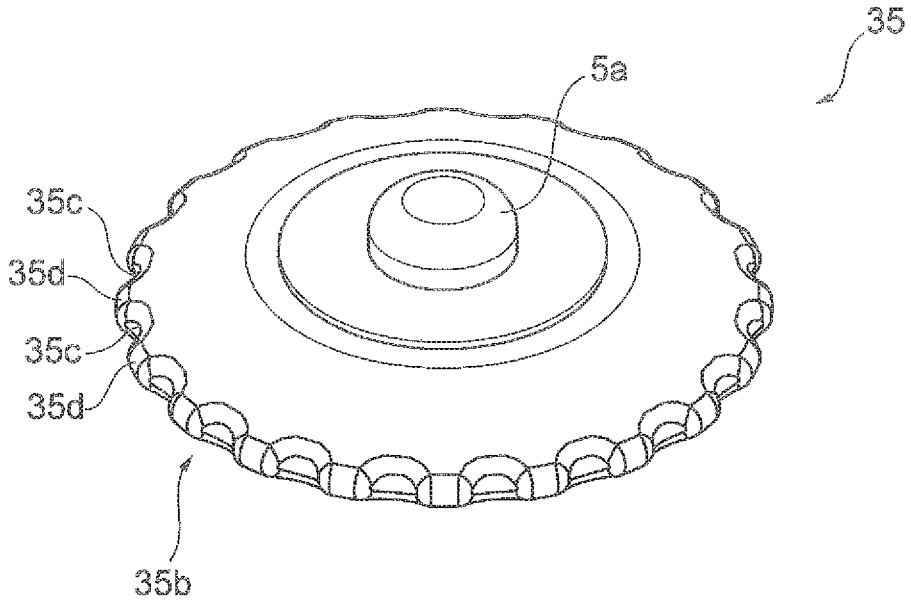
FIG. 15 is a perspective view illustrating an application body of a cosmetic container with application body according to a sixth embodiment.
Figure 16:
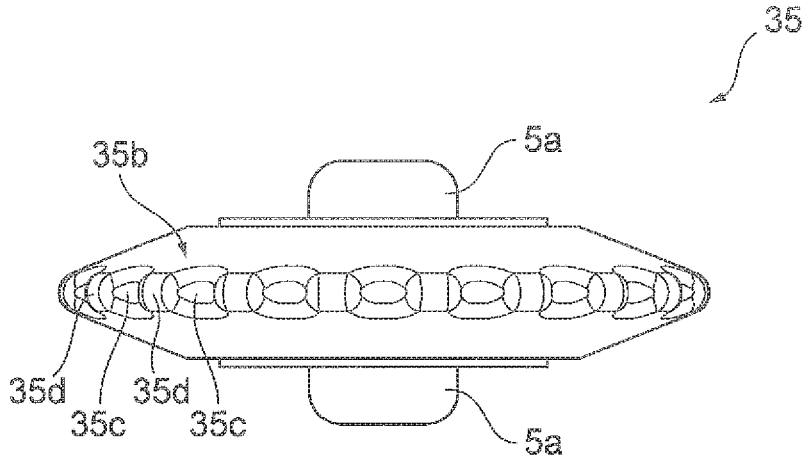
FIG. 16 is a side view of the application body illustrated in FIG. 15.

Hereinafter, embodiments of a cosmetic container with application body will be described with reference to FIGS. 1 to 16. FIGS. 1 to 6 illustrate a first embodiment, FIG. 7 illustrates a second embodiment, FIGS. 8 to 10 illustrate a third embodiment, FIGS. 11 and 12 illustrate a fourth embodiment, FIGS. 13 and 14 illustrate a fifth embodiment, and FIGS. 15 and 16 illustrate a sixth embodiment, respectively.

Figure 4:
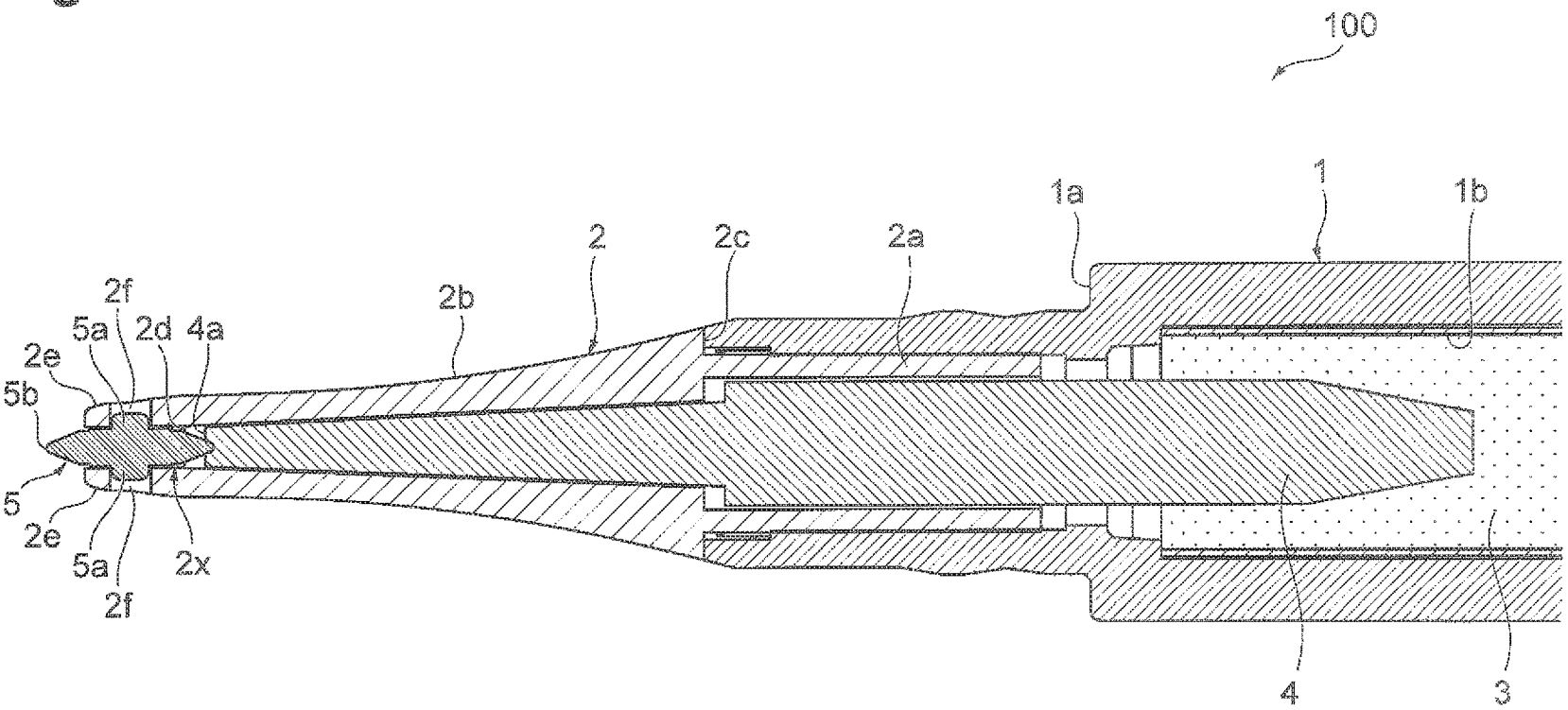
FIG. 4 is a longitudinal sectional view of a main part of FIG. 3.

First, the first embodiment illustrated in FIGS. 1 to 6 will be described. Each of FIGS. 1 to 4 illustrates a cosmetic container with application body according to the first embodiment, and each of FIGS. 5 and 6 illustrates an application body.

The cosmetic container with application body of the present embodiment is used when a liquid cosmetic is applied to a skin, or the like corresponding to an applied portion. In particular, the cosmetic container with application body of the present embodiment is suitable for an eyeliner or the like to draw a thin line on an eyelid or an eyebrow pencil or the like to draw a thin line of eyebrows.

Figure 1:
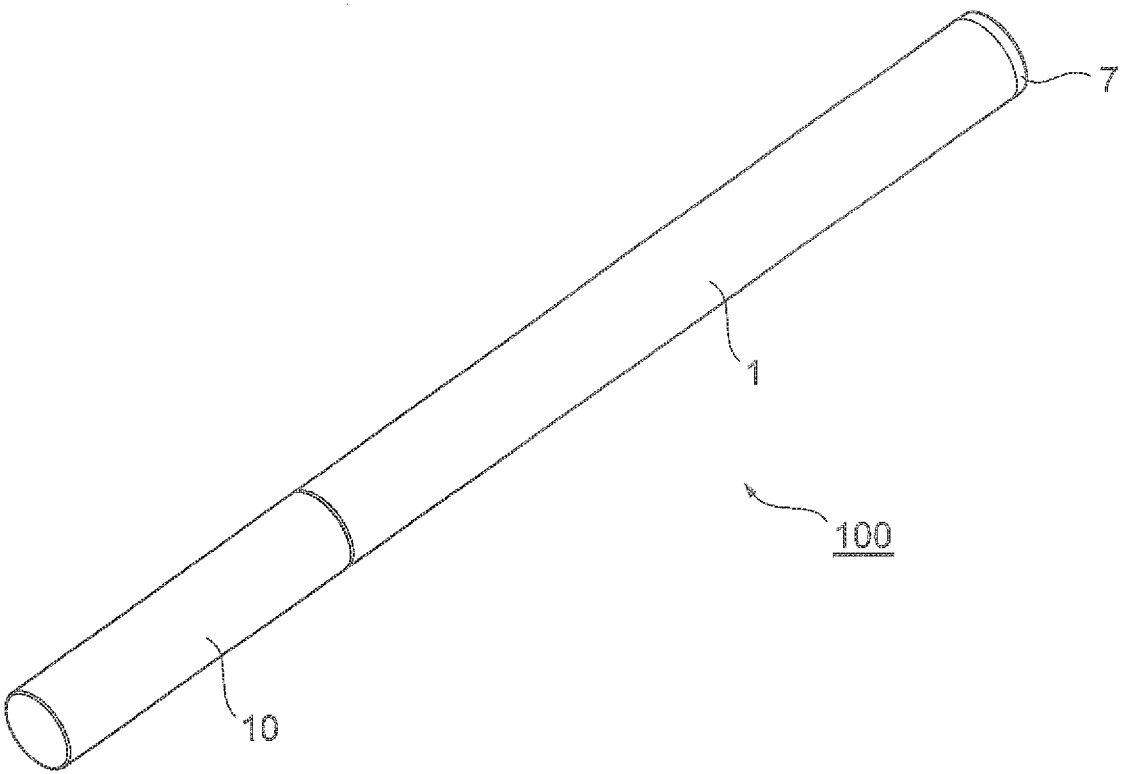
FIG. 1 is a perspective view illustrating an appearance of a cosmetic container with application body according to a first embodiment.
Figure 2:
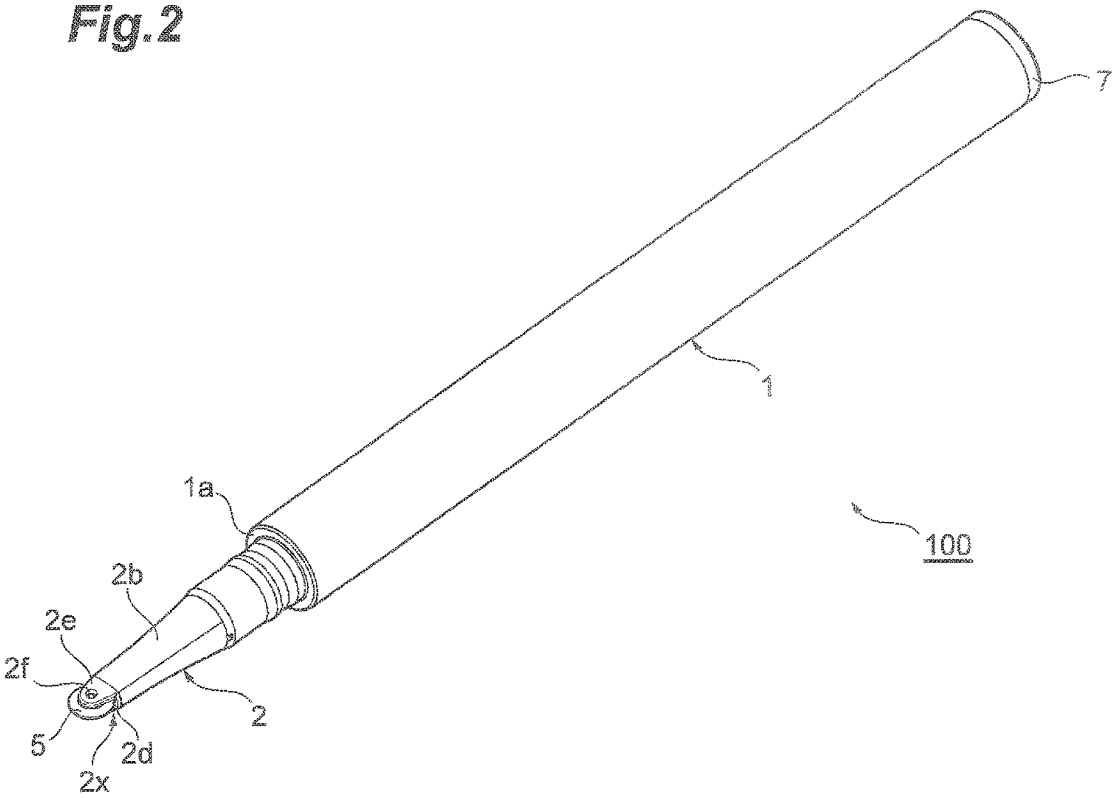
FIG. 2 is a perspective view illustrating a state in which a cap is removed from a state of FIG. 1.
Figure 3:
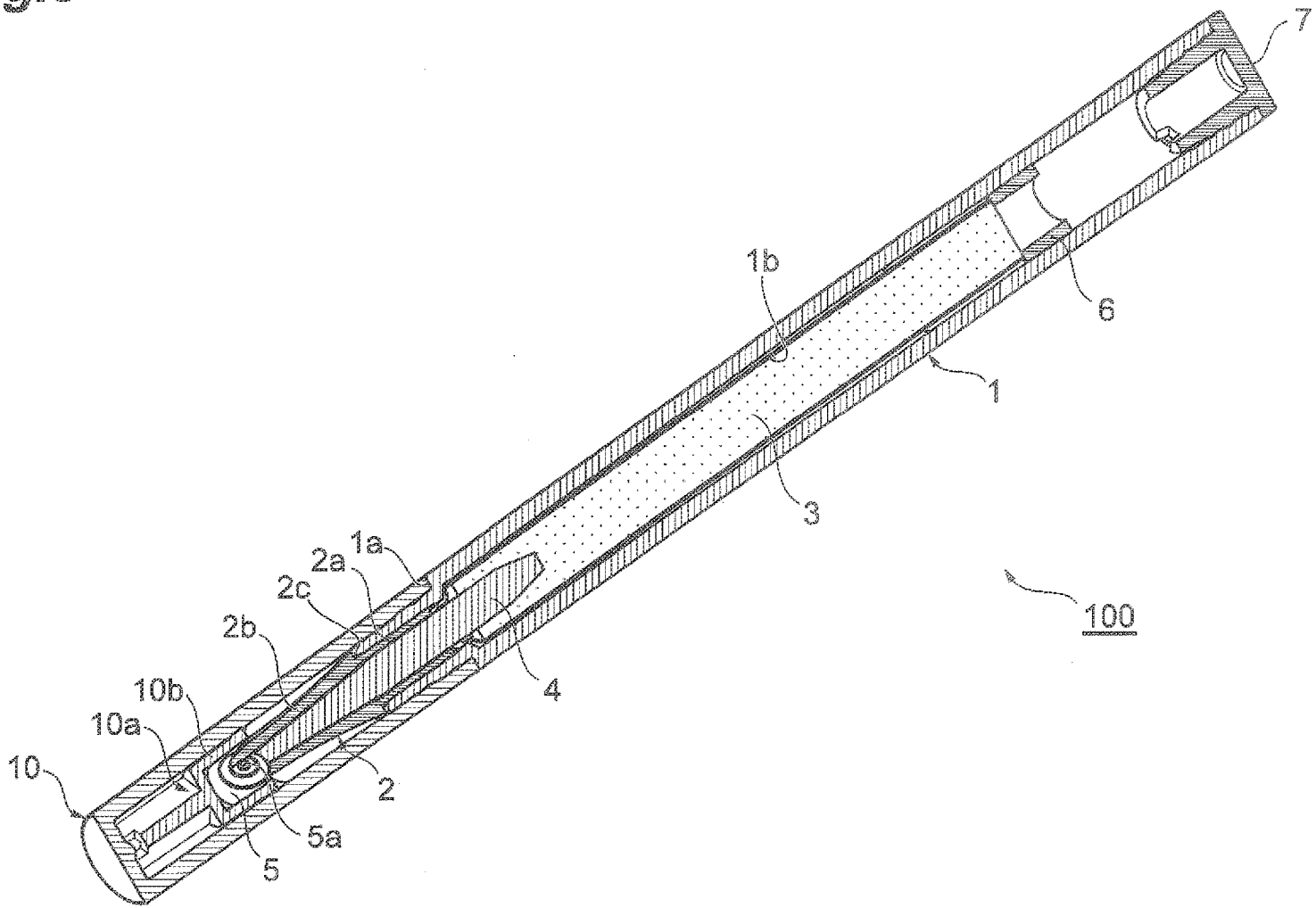
FIG. 3 is a longitudinal perspective view of the cosmetic container with application body illustrated in FIG. 1.

As illustrated in FIGS. 1 to 3, a cosmetic container with application body 100 largely includes a main container body 1 and a front tube 2 constituting an outline of the container, inner cotton 3 accommodated in the main container body 1, an intermediate core 4 accommodated in the main container body 1 and the front tube 2, and an application body 5 installed at a tip of the front tube 2.

For example, the main container body 1 is made of PP and is formed in a cylindrical shape which is stepped and tapered toward an end. As illustrated in FIG. 3, a tube hole on a rear side of a stepped portion 1*a* of the main container body 1 serves as an accommodation portion 1*b* for accommodating the liquid cosmetic. The accommodation portion 1*b* is filled with the inner cotton 3 impregnated with the liquid cosmetic. A size of the inner cotton 3 is adjustable by an adjuster 6. An opening at a rear end of the main container body 1 is closed by installing a tail plug 7.

For example, the front tube 2 is made of PP. Referring to the front tube 2, as illustrated in FIGS. 2 to 4, a rear half portion 2*a* is formed in a cylindrical shape, and thus a front side serves as a flat cylindrical portion 2*b*, Referring to the flat cylindrical portion 2*b*, an outer surface has a diameter enlarged toward the rear half portion 2*a* through the stepped portion 2*c*, and a cross section (section perpendicular to an axial line direction) has a quadrangular tubular shape substantially corresponding to a rectangle. In addition, referring to the flat cylindrical portion 2*b*, both outer surfaces on a major axis side and a minor axis side of the quadrangular tubular shape on the cross section have tapered shapes to become smaller while being slightly bent inward toward the tip. Referring to a flat tube hole of the flat cylindrical portion 2*b* and a circular tube hole of the rear half portion 2*a*, a diameter on a major axis side of the flat tube hole matches a diameter of the circular tube hole (see FIG. 3). A diameter on a minor axis side of the flat tube hole is smaller than the diameter of the circular tube hole through steps (see FIG. 4).

As illustrated in FIGS. 2 and 4, an outlet 2*x* corresponding to an opening of the tip of the front tube 2 serves as an outlet of the liquid cosmetic. The front tube 2 includes, on a minor axis side of an opening edge (in a vertical direction of FIG. 4), a pair of projections 2*e* facing each other and extruding forward from an opening edge 2*d* on a major axis side (in a direction perpendicular to a paper surface of FIG. 4). Each of the projections 2*e* is provided with a support hole 2*f* that penetrates the projection 2*e* in a minor axis direction to rotatably support the application body 5.

Referring to the front tube 2, the cylindrical rear half portion 2*a* enters a tube of a cylindrical tip portion of the main container body 1, and the stepped portion 2*c* abuts against an apical surface of the main container body 1. In this state, the front tube 2 is installed in the main container body 1 such that the front tube 2 can neither rotate nor move in the axial line direction. In addition, in this state, the tube hole of the main container body 1 communicates with the tube hole of the front tube 2.

For example, the intermediate core 4 is formed by hardening and grinding polyester, nylon using glue. The intermediate core 4 extends in the axial line direction. As illustrated in FIGS. 3 and 4, the intermediate core 4 is disposed inside the tube holes of the main container body 1 and the front tube 2. A portion on a rear end side of the intermediate core 4 is inserted into the inner cotton 3. In addition, a portion on a tip side of the intermediate core 4 extends toward the outlet 2*x* at the tip of the front tube 2. The intermediate core 4 sucks up the liquid cosmetic of the inner cotton 3 using a capillary phenomenon, and supplies the liquid cosmetic to a tip of the intermediate core 4.

For example, the application body 5 is made of POM, and is formed in a disc shape as illustrated in FIGS. 5 and 6. Here, the disc-shaped application body 5 has a shape of a convex lens. The application body 5 includes a shaft 5*a* extruding outward in an axial line direction from an outer surface at a position of a central axis.

Referring to the application body 5, in the first embodiment and the second to sixth embodiments to be described below, an outer peripheral surface 5*b* serving as a coating face is not sharp and has a shape rounded in an R-shape such that a skin is not hurt at the time of application.

As illustrated in FIG. 4, the disc-shaped application body 5 is pushed in between the projections 2*e* and 2*e* while the projections 2*e* and 2*e* of the front tube 2 facing each other are slightly expanded in the minor axis direction, and the shafts 5*a* and 5*a* enter the support holes 2*f* and 2*f* of the front tube 2. In this way, the application body 5 is rotatably supported at a tip portion of the front tube 2. In addition, the disc-shaped application body 5 is in a state in which the outer peripheral surface 5*b* thereof touches an apical surface 4*a* of the intermediate core 4 by an appropriate force. A thickness of the application body 5 except for the shafts 5*a* is substantially the same as a width of the tip of the intermediate core 4. In this way, a compact container is attempted to be achieved.

The application body 5 may be configured as two components corresponding to the central axis and a disc portion excluding the central axis, and the application body 5 may be integrated by fitting the central axis into the disc portion excluding the central axis. In this case, the configuration in which the central axis is made of POM and the disc portion is made of nylon or polyester is exemplified.

As illustrated in FIGS. 1 and 3, a cap 10 having a bottomed cylindrical shape for protecting, for example, the application body 5 is detachably installed at the tip of the container. An inner cap 10*a* is further provided inside the cap 10. For example, the cap 10 and the inner cap 10*a* are made of PP. The inner cap 10*a* includes an accommodation portion 10*b* having a bottomed cylindrical shape. When the cap 10 is installed at the tip of the main container body 1, the inner cap 10*a* accommodates the disc-shaped application body 5 in the accommodation portion 10*b*. The accommodation portion 10*b* reduces a remaining amount of air by filling a space inside the cap 10, thereby attributing to suppressing volatilization. When the cap 10 is installed at the tip of the main container body 1, and the cap 10 is fit to the tip of the main container body 1, air tightness inside the container is maintained.

In the cosmetic container with application body 100 configured as described above, the liquid cosmetic impregnated into the inner cotton 3 is sent to the apical surface 4*a* of the intermediate core 4 through the intermediate core 4 by the capillary phenomenon, and is transferred to the outer peripheral surface 5*b* of the application body 5 touching the apical surface 4*a*.

In this state, for example, when a thin line is drawn on a skin by the eyeliner or the eyebrow pencil, for example, the cosmetic container with application body 100 is moved along the skin like drawing a line using a brush in a state in which the application body 5 is pressed on the skin.

Then, the disc-shaped application body 5 is rotated, and the liquid cosmetic is transferred to the skin by the rotated application body 5 to draw a thin line.

As described above, in the present embodiment, the application body 5 is in contact with the intermediate core 4 that sends out the liquid cosmetic inside the container, and is disposed in the outlet 2*x* of the liquid cosmetic at the tip of the container. In addition, the application body 5 has a disc shape and rotates to draw a line at the time of application. In other words, the disc-shaped application body 5 rotates at the time of application, and thus a previously occurring phenomenon in which the tip is stuck is suppressed. As a result, a sense of use can be improved without the skin being pulled, and a clear line can be drawn without the line becoming discontinuous.

In addition, the disc-shaped application body 5 has a shape of a convex lens, and thus is suitable for the eyeliner, the eyebrow pencil, or the like to draw a thin line.

FIG. 7 is a longitudinal sectional view illustrating a main part of a cosmetic container with application body according to the second embodiment.

A cosmetic container with application body 200 of the second embodiment is different from the cosmetic container with application body 100 of the first embodiment in that a second intermediate core 8 softer than the intermediate core 4 is interposed between the application body 5 and the intermediate core 4. The second intermediate core 8 is made of a material softer than the intermediate core 4. Here, for example, the second intermediate core 8 is regarded as a sponge.

According to the second embodiment, the second intermediate core 8 softer than the intermediate core 4 is interposed between the application body 5 and the intermediate core 4. Thus, the second intermediate core 8 is in contact with the application body 5 by an appropriate force at all times, and can reliably transfer the liquid cosmetic to the application body 5 without hindering the application body 5 from rotating.

FIG. 8 is a partially broken perspective view illustrating a cosmetic container with application body according to the third embodiment, FIG. 9 is a partially broken perspective view illustrating a resin-spring-equipped front tube and an intermediate core of FIG. 8, and FIG. 10 is a perspective view illustrating the resin-spring-equipped front tube of FIG. 9.

A cosmetic container with application body 300 of the third embodiment is different from the cosmetic container with application body 100 of the first embodiment in that a resin-spring-equipped front tube 22 is used instead of the front tube 2 of the first embodiment.

The resin-spring-equipped front tube 22 has a configuration in which a resin spring 12 extends backward from a rear end of the front tube 2 of the first embodiment. For example, the resin-spring-equipped front tube 22 is an integrated molded article made of PP. The resin spring 12 includes a spiral-shaped slit 12*a*, and has a shape of a double screw. In the third embodiment, as illustrated in FIG. 9, an outer peripheral surface of a rear portion of an intermediate core 4 has a diameter enlarged than a front side through a stepped portion 4*b*. An inner peripheral surface of a rear end portion of the resin spring 12 is fixedly installed on the outer peripheral surface having the enlarged diameter.

According to the third embodiment, the resin spring 12 energizes the intermediate core 4 forward to press an apical surface 4*a* of the intermediate core 4 on an outer peripheral surface 5*b* of an application body 5. Thus, the intermediate core 4 is in contact with the application body 5 by an appropriate force at all times, and can reliably transfer the liquid cosmetic to the application body 5 without hindering the application body 5 from rotating.

An elastic body other than the resin spring 12 may be used as long as the elastic body has the same effect as that of the resin spring 12.

FIG. 11 is a perspective view illustrating an application body of a cosmetic container with application body according to the fourth embodiment, and FIG. 12 is a side view of the application body illustrated in FIG. 11.

An application body 15 of the fourth embodiment is different from the application body 5 of the first embodiment in that a groove for liquid accumulation 15*b* is provided in an annular shape along a circumferential direction on an outer peripheral surface of the disc-shaped application body.

According to the fourth embodiment, a liquid cosmetic is excellently contained by the groove for liquid accumulation 15*b* at the time of application. As a result, a clearer line can be drawn.

FIG. 13 is a perspective view illustrating an application body of a cosmetic container with application body according to the fifth embodiment, and FIG. 14 is a side view of the application body illustrated in FIG. 13.

An application body 25 of the fifth embodiment is different from the application body 5 of the first embodiment in that the disc-shaped application body includes an annular (ring-shaped) outer peripheral portion 25*a* and a space portion 25*b* on an inner circumference side of the outer peripheral portion 25*a*.

The space portion 25*b* has a configuration for supporting the annular outer peripheral portion 25*a* with respect to a columnar central portion 25*c* having a shaft 5*a* by a plurality of support ribs (here, three support ribs) 25*d* spaced apart in a circumferential direction. In this way, the space portion 25*b* is formed between the support ribs 25*d* and 25*d*.

According to the fifth embodiment, a liquid cosmetic does not adhere to the space portion 25*b* on the inner circumference side of the annular outer peripheral portion 25*a*. Thus, even when the application body 25 sinks into (digs into) a skin at the time of application, only a liquid cosmetic transferred to the annular outer peripheral portion 25*a* is applied to the skin. Therefore, it is possible to draw a line having a desired constant thickness (constant and thin line) without variation at all times.

The support ribs 25*d* escapes by being dented inward in an axial line direction (dented in a vertical direction of FIG. 13) from the annular outer peripheral portion 25*a*. For this reason, the liquid cosmetic does not adhere to the support ribs 25*d*.

An application body may be configured such that a thickness in the axial line direction of a portion on the inner circumference side of the annular outer peripheral portion 25*a* is smaller than a thickness in the axial line direction of the annular outer peripheral portion 25*a* (dented inward in the axial line direction) without providing the space portion 25*b* to the disc-shaped application body. When this configuration is employed, the portion on the inner circumference side of the annular outer peripheral portion 25*a* escapes by being dented inward in the axial line direction from the outer peripheral portion 25*a* similarly to the support ribs 25*d*. For this reason, even when the application body sinks into a skin at the time of application, only a liquid cosmetic of the annular outer peripheral portion 25*a* is applied to the skin. Therefore, it is possible to draw a line having a desired constant thickness without variation at all times similarly to the application body 25 illustrated in FIGS. 13 and 14.

FIG. 15 is a perspective view illustrating an application body of a cosmetic container with application body according to the sixth embodiment, and FIG. 16 is a side view of the application body illustrated in FIG. 15.

An application body 35 of the sixth embodiment is different from the application body 5 of the first embodiment in that an uneven portion 35*b*, in which recessions 35*c* and projections 35*d* are continuously disposed along a circumferential direction, is provided to an outer peripheral surface 5*b* of the disc-shaped application body.

According to the sixth embodiment, a liquid cosmetic adheres to the uneven portion 35*b* of the application body 35. In particular, eyelashes enter the recessions 35*c*. Thus, the liquid cosmetic is easily applied between eyelashes by the projections 35*d*.

The aspect of the invention has been described in detail based on the embodiments thereof. However, the invention is not limited to the above embodiments. For example, while the above embodiments employ an inner-cotton type in which the inner cotton 3 impregnated with the liquid cosmetic is accommodated in the main container body 1, and the liquid cosmetic is supplied to the application bodies 5, 15, and 25 through the intermediate core 4 from the inner cotton 3, it is possible to employ a direct liquid type in which an inside of the main container body 1 is directly filled with the liquid cosmetic without the inner cotton 3, and the liquid cosmetic is supplied to the application bodies 5, 15, and 25 through the intermediate core 4 while a flow rate of the liquid cosmetic is controlled by a bellows structure. In this bellows structure, for example, acrylic resin can be used as the intermediate core 4.

In addition, in the above embodiments, the main container body 1 and the front tube 2 are configured as separate components. However, the main container body 1 and the front tube 2 may be configured as an integrated container as a matter of course.

INDUSTRIAL APPLICABILITY

According to an aspect of the invention, it is possible to provide a cosmetic container with application body capable of improving a sense of use without a skin being pulled, and clearly drawing a line without the line being discontinuous.

REFERENCE SIGNS LIST

1 . . . Main container body, 2, 22 . . . Front tube, 4 . . . Intermediate core, 5, 15, 25, 35 . . . Application body, 8 . . . Second intermediate core, 15*b* . . . Groove for liquid accumulation, 25*a* . . . Annular outer peripheral portion, 25*b* . . . Space portion, 100, 200, 300 . . . Cosmetic container with application body

The invention claimed is:

1. A cosmetic container with an application body, a liquid cosmetic accommodated in the cosmetic container being supplied to the application body provided at a tip of the cosmetic container through an intermediate core, the liquid cosmetic being applicable by the application body;

wherein the application body is disc-shaped, and corresponds to a shape of a convex lens, wherein the application body is rotatably provided at an outlet of the liquid cosmetic at the tip of the container, and in contact with the intermediate core, wherein the application body includes a central mounting portion for mounting the application body at the tip, an annular outer peripheral portion, an outer peripheral surface, and one or more support ribs extending between the annular outer peripheral portion and the central mounting portion, wherein the central mounting portion defines a rotation axis of the application body, and wherein the one or more support ribs has a height greater than the outer peripheral surface and smaller than the annular outer peripheral portion, in the direction of the rotation axis.

2. The cosmetic container with application body according to claim 1, wherein the disc-shaped application body includes a groove for liquid accumulation in an annular shape along a circumferential direction on the outer peripheral surface of the application body.

3. The cosmetic container with application body according to claim 1, wherein one or more space portions are formed between the central mounting portion and the annular outer peripheral portion.

4. The cosmetic container with application body according to claim 1, further comprising an accommodation portion for accommodating the liquid cosmetic, wherein the intermediate core comprises a first intermediate core component and a second intermediate core component, the second intermediate core component being softer than the first intermediate core component and being interposed between the application body and the first intermediate core component, and wherein the first intermediate core component is inserted in the accommodation portion in order to draw the cosmetic liquid from the accommodation portion, and partially extends out of the accommodation portion in order to space apart the second intermediate core component from the accommodation portion.

5. The cosmetic container with application body according to claim 1, wherein the one or more support ribs are at least partially indented relative to the annular outer peripheral portion, in the direction of the rotation axis.

6. A cosmetic applicator comprising:

an accommodation portion for containing a liquid cosmetic;

an application body provided at a tip of the cosmetic applicator for dispensing the liquid cosmetic; and an intermediate core extending from the accommodation portion to the application body, the intermediate core having an outlet for supplying the liquid cosmetic to the application body;

wherein the application body is disc-shaped and includes:

an outer peripheral surface, a central mounting portion configured to rotatably mount the application body at the tip of the cosmetic applicator and defining a rotation axis of the application body, an annular outer portion operably connected to the central mounting portion and configured to contact the outlet of the intermediate core, one or more openings are provided between the central mounting portion and the annular outer portion, and one or more support ribs extending between the central mounting portion and the annular outer portion and forming the one or more openings, wherein the one or more support ribs has a height greater than height of the outer peripheral surface and smaller than height of the annular outer portion, in the direction of the rotation axis.

7. A cosmetic applicator according to claim 6, wherein the one or more support ribs are at least partially indented relative to the annular outer portion, in a direction of the rotation axis.

8. A cosmetic applicator comprising:

a container for storing a liquid cosmetic;

an intermediate core provided in the container, for drawing the liquid cosmetic; and an application body provided at a tip of the container for dispensing the liquid cosmetic, the application body being disc-shaped and comprising:

an outer peripheral surface, a central mounting portion configured to rotatably mount the application body to the container, and defining a rotation axis of the application body, an outer portion being annular-shaped and configured to receive the liquid cosmetic from the intermediate core, the outer portion having a thickness in a direction of the rotation axis, and a support structure spanning between the central mounting portion and the outer portion, the support structure having a thickness in the direction of the rotation axis, wherein the thickness of the support structure is less than the thickness of the outer portion and greater than the outer peripheral surface.

9. A cosmetic applicator according to claim 8, wherein the support structure is at least in part indented relative to the outer portion in the direction of the rotation axis.

10. A cosmetic applicator according to claim 8, wherein the support structure comprises one or more support ribs.

11. A cosmetic applicator according to claim 8, wherein one or more openings are provided between the outer portion and the central mounting portion.

12. A cosmetic applicator according to claim 11, wherein each of the one or more openings passes completely through the application body.

13. A cosmetic applicator according to claim 8, wherein the outer portion comprises an outer coating side configured to apply the liquid cosmetic, and an inner side opposite the outer coating side, and wherein the support structure is at least in part indented relative to the inner side of the outer portion, in the direction of the rotation axis.

14. A cosmetic applicator according to claim 13, wherein the support structure comprises a first end adjacent the central mounting portion and a second end adjacent the outer portion, and wherein the second end is indented relative the inner side of the outer portion, in the direction of the rotation axis.

15. A cosmetic applicator according to claim 13, wherein the inner side forms an inner circumference of the outer portion, the support structure comprises a plurality of support ribs spaced apart along the inner circumference, and a plurality of openings are provided between the plurality of support ribs.

16. A cosmetic applicator according to claim 8, wherein the container comprises an accommodation portion for containing the liquid cosmetic, and wherein the intermediate core is partially inserted in the accommodation portion to transfer the cosmetic liquid from the accommodation portion to the outer portion of the application body.

17. A cosmetic applicator according to claim 16, wherein the container further comprises an elastic body to maintain contact between the intermediate core and the outer portion of the application body.

* * * * *